US008458857B1

(12) United States Patent
Davis et al.

(10) Patent No.: US 8,458,857 B1
(45) Date of Patent: Jun. 11, 2013

(54) BLOCKING CLOSURE OF A PASSAGEWAY

(75) Inventors: Raymond E. Davis, Heath, TX (US); Clifton Glenn Hampton, Burleson, TX (US)

(73) Assignee: ADCO Industries—Technologies, L.P., Dallas, TX (US)

( * ) Notice: Subject to any disclaimer, the term of this patent is extended or adjusted under 35 U.S.C. 154(b) by 0 days.

(21) Appl. No.: 13/358,709

(22) Filed: Jan. 26, 2012

(51) Int. Cl.
*E05F 5/02* (2006.01)
*E05C 19/18* (2006.01)

(52) U.S. Cl.
USPC ..... 16/82; 16/49; 16/85; 16/412; 292/288

(58) Field of Classification Search
USPC ..... 16/83, 82, DIG. 17, 85, 412, 413, 16/422, 405; 49/383, 70; 292/296–298, 340, 292/341.17, 121, 108, DIG. 15, DIG. 29, 292/341.14
See application file for complete search history.

(56) References Cited

U.S. PATENT DOCUMENTS

| | | | | | |
|---|---|---|---|---|---|
| 1,036,890 | A * | 8/1912 | Ogden | 292/288 |
| 1,414,286 | A * | 4/1922 | Keller | 16/86 A |
| 1,766,183 | A * | 6/1930 | Mealia | 16/82 |
| 2,364,795 | A * | 12/1944 | Koehler | 292/74 |
| 2,709,615 | A * | 5/1955 | Barnes, Jr. et al. | 292/339 |
| 3,172,168 | A * | 3/1965 | Suska | 49/400 |
| 3,391,674 | A * | 7/1968 | Burleigh | 119/174 |
| 3,676,895 | A * | 7/1972 | Stewart | 16/412 |
| 3,862,774 | A * | 1/1975 | Johnson | 292/228 |
| 4,575,140 | A * | 3/1986 | Dargis | 292/288 |
| 4,797,970 | A * | 1/1989 | Charlton | 16/82 |
| 4,817,239 | A * | 4/1989 | Campbell | 16/413 |
| 6,244,636 | B1 * | 6/2001 | Rissone | 292/202 |
| 6,327,743 | B1 * | 12/2001 | Rashid et al. | 16/82 |
| 6,510,587 | B2 * | 1/2003 | Urschel et al. | 16/83 |
| 6,550,186 | B2 * | 4/2003 | Haq | 49/383 |
| 6,557,209 | B1 * | 5/2003 | Wood et al. | 16/82 |
| 6,874,198 | B2 * | 4/2005 | Renaud | 16/83 |
| 7,155,776 | B2 | 1/2007 | Park | |
| 7,281,300 | B2 | 10/2007 | Andersen et al. | |
| 7,331,617 | B2 | 2/2008 | Johnson | |
| 7,416,230 | B2 | 8/2008 | Konstantakis et al. | |
| 7,537,250 | B1 | 5/2009 | Gustafson | |
| 8,028,376 | B2 * | 10/2011 | Karapetyan | 16/82 |
| 8,060,982 | B2 * | 11/2011 | Magoz et al. | 16/83 |
| 8,177,266 | B2 | 5/2012 | Yates | |
| 8,276,240 | B2 | 10/2012 | Ritachka | |
| 2002/0157319 | A1 * | 10/2002 | Haq | 49/383 |
| 2003/0070256 | A1 | 4/2003 | Kuwica | |
| 2005/0005402 | A1 * | 1/2005 | Moody | 16/413 |

(Continued)

FOREIGN PATENT DOCUMENTS

| | | | |
|---|---|---|---|
| GB | 2383084 | A * | 6/2003 |
| WO | WO 9906660 | A1 * | 2/1999 |

*Primary Examiner* — Victor Batson
*Assistant Examiner* — Emily Morgan
(74) *Attorney, Agent, or Firm* — Fish & Richardson P.C.

(57) ABSTRACT

A device includes a base attachable to a first side of a door; a swing arm coupled to the base, the swing arm including a bracket flange configured to extend across an edge of the door between the first side of the door and a second side of the door opposite the first side of the door; and a biasing member coupled between the swing arm and the base and configured to urge the swing arm from a retracted position in which the bracket flange is adjacent the edge to an extended position in which the bracket flange is apart from the edge.

21 Claims, 9 Drawing Sheets

U.S. PATENT DOCUMENTS

2005/0161954 A1 7/2005 Miskin
2005/0193520 A1* 9/2005 Bushey ..... 16/82
2008/0277949 A1 11/2008 Emde et al.
2010/0107362 A1* 5/2010 Karapetyan ..... 16/82
2012/0030902 A1 2/2012 Dufek
2012/0223535 A1 9/2012 Yates

* cited by examiner

BLOCKING CLOSURE OF A PASSAGEWAY

TECHNICAL BACKGROUND

This disclosure relates to an apparatus for preventing a structure from completely or substantially closing flush against a frame.

BACKGROUND

Various apparatus are used to prevent doors (or other entry/exit structures, such as, for example, gates, panels, or other structures) from contacting other objects. For example, a stop is a device that can be used to hold a door open or closed in order to prevent a door from contacting another object or from opening too widely. In some instances, a stop can prevent the door from coming into contact with a wall surface on which the doorframe is mounted. In other examples, a stop can be a movable device that is disposed on a floor and adjacent the surface of a doorframe in order to prevent a hinged door or a sliding door from closing securely within a doorframe. In some examples, a movable door stop can also be disposed on a floor in proximity to a doorway and seated beneath the surface of a hinged door such that the door is prevented from closing beyond the position of the stop. While such movable stops can prevent accidents in some examples, movable stops can sometimes become displaced from their intended positions and thus fail to prevent a door from closing completely on an object within a doorframe.

SUMMARY

In one general embodiment, a device includes a base attachable to a first side of a door; a swing arm coupled to the base, the swing arm including a bracket flange configured to extend across an edge of the door between the first side of the door and a second side of the door opposite the first side of the door; and a biasing member coupled between the swing arm and the base and configured to urge the swing arm from a retracted position in which the bracket flange is adjacent the edge to an extended position in which the bracket flange is apart from the edge.

In another general embodiment, a method includes attaching a base of a blocking device to a first side of a door; urging a swing arm including a bracket flange, and coupled to the base, towards an edge of the door extending between the first side of the door and a second side of the door opposite the first side of the door; closing the door substantially flush against a doorframe such that the bracket flange is positioned between the edge of the door and the doorframe; and opening the door such that the swing arm is urged away from the edge of the door by a biasing member coupled between the swing arm and the base.

In a first aspect combinable with any of the general embodiments, the biasing member is configured to pivotally urge the swing arm away from the base.

In a second aspect combinable with any of the previous aspects, the base includes an enclosure and a plate.

A third aspect combinable with any of the previous aspects includes a stop coupled to the bracket flange.

In a fourth aspect combinable with any of the previous aspects, the enclosure includes a cutout having a shape that accommodates the stop.

In a fifth aspect combinable with any of the previous aspects, the device is configured for use with a right hand hinge door having a normal swing direction or a reverse swing direction.

In a sixth aspect combinable with any of the previous aspects, the door block is configured for use with a left hand hinge door having a normal swing direction or a reverse swing direction.

In a seventh aspect combinable with any of the previous aspects, the base is attachable to the first side of the door via a piece of double-sided tape.

In an eighth aspect combinable with any of the previous aspects, a width of the bracket flange is about 1⅜ inches.

In a ninth aspect combinable with any of the previous aspects, a thickness of the bracket flange ranges from approximately 1/32 inch to 3/32 inch.

In a tenth aspect combinable with any of the previous aspects, the biasing member includes a coil spring.

In an eleventh aspect combinable with any of the previous aspects, at least a portion of the biasing member is enclosed within the enclosure.

A twelfth aspect combinable with any of the previous aspects includes at least one pull handle.

In a thirteenth aspect combinable with any of the previous aspects, the at least one pull handle is coupled to at least one of the stop or the bracket flange.

In a fourteenth aspect combinable with any of the previous aspects, the bracket flange is configured to be urged against the edge, such that the biasing member is extended and the swing arm is disposed in a retracted position.

A fifteenth aspect combinable with the general embodiment includes prior to urging the swing arm towards the edge of the door, urging the door towards the doorframe until the swing arm contacts the doorframe to form a gap between the door and the doorframe.

A sixteenth aspect combinable with any of the previous aspects includes subsequent to the swing arm contacting the door frame, urging the swing arm towards the edge of the door until the swing arm is adjacent the edge.

In a seventeenth aspect combinable with any of the previous aspects, urging a swing arm including a bracket flange, and coupled to the base, towards an edge of the door extending between the first side of the door and a second side of the door opposite the first side of the door includes pivotally urging the swing arm towards the edge of the door extending between the first side of the door and the second side of the door.

In an eighteenth aspect combinable with any of the previous aspects, pivotally urging the swing arm towards the edge of the door extending between the first side of the door and the second side of the door includes applying a force on a pull handle coupled to the swing arm to pivot the swing arm towards the edge of the door.

In a nineteenth aspect combinable with any of the previous aspects, attaching a base of a blocking device to a first side of a door includes orienting an edge of the base substantially parallel to the edge of the door.

Various embodiments of a device for blocking closure of a door or other moveable structure according to the present disclosure may include one or more of the following features. For example, the device can include a base that is attachable to a first side of a door and a swing arm that is coupled to the base. In some examples, the swing arm includes a stop and a bracket flange that can extend across an edge of the door from the first side of the door to a second side of the door. In some instances, the device further includes a biasing member that couples the swing arm to the base and which can be housed within the base.

Various embodiments of a device according to the present disclosure may also include one or more of the following features. For example, the biasing member can be configured to urge the swing arm away from the base, such that the swing arm is disposed in an extended position and the stop can prevent the door from closing completely within a doorframe. In some examples, the bracket flange can be urged flush against the edge of the door, such that the biasing member extends and thereby disposes the swing arm in a retracted position.

Various embodiments of a device according to the present disclosure may also include one or more of the following features. In some embodiments, the device may be configured for use with one or more door configurations including a left hand hinge door having a normal swing direction, a left hand hinge door having a reverse swing direction, a right hand hinge door having a normal swing direction, and a right hand hinge door having a reverse swing direction.

Various embodiments of a device according to the present disclosure may also include one or more of the following advantages. In some examples, the device can act as a safety mechanism by preventing a door from smashing a small object, such as a finger or a child's hand, between a door and a doorframe. By positioning the device at a sufficient height along the door, a small child can further be prevented from having access to the device and thus from adapting the device from an extended configuration to a retracted configuration and vice versa. In some instances, the device can be used to maintain a door ajar from a doorframe, irrespective of associated safety aspects of the device. In some cases, the attachable feature of the device can remove the need to check the positioning of the device and the need to reposition the device, in contrast to movable, floor-seated devices that can easily be displaced from their intended positions and thus may require repositioning.

These general and specific aspects may be implemented using a device, system or method, or any combinations of devices, systems, or methods. The details of one or more implementations are set forth in the accompanying drawings and the description below. Other features, objects, and advantages will be apparent from the description, the drawings, and the claims.

DETAILED DESCRIPTION

This disclosure relates to an apparatus for preventing an entry/exit structure from completely or substantially closing flush against a frame, and more particularly, to a door block used for preventing a door from smashing an object, such as a finger, between a door and a doorframe as the door closes toward the doorframe. In a general embodiment, a device for blocking closure of a door or other moveable structure includes a base that is attachable to a first side of a door and a swing arm that is coupled to the base. In some examples, the swing arm includes a bracket flange that can extend across an edge of the door from the first side of the door to a second side of the door. The swing arm can further include a stop that may prevent the door from closing completely within the doorframe.

In some embodiments, the device further includes a biasing member that couples the swing arm to the base. In some examples, the biasing member can be housed within the base. In some examples, the biasing member can be configured to urge the swing arm away from the base, such that the swing arm is disposed in an extended position and the stop can prevent the door from completely or substantially closing within the doorframe, thereby further preventing the door from smashing an object, such as a finger, on a doorframe. In some examples, the bracket flange can be urged against the edge of the door, such that the biasing member extends and thereby disposes the swing arm in a retracted position. In some embodiments, the base can include a cutout having the shape of the stop and accommodating the stop when the swing arm is disposed in a retracted position. In a retracted configuration, the device can allow the door to close completely within a surrounding doorframe.

In some embodiments, the device can include one or more pull handles coupled to the stop and/or the bracket flange for urging the swing arm towards the base. In some embodiments, the device can be configured for use with one or more door configurations including a left hand hinge door having a normal swing direction, a left hand hinge door having a reverse swing direction, a right hand hinge door having a normal swing direction, and a right hand hinge door having a reverse swing direction.

In some examples, the door block can act as a safety mechanism by preventing a door from smashing a small object, such as a finger or a child's hand, between the door and the doorframe. By attaching the device to the door at a sufficient height, a small child can further be prevented from having access to the device. In some examples, the device can be used to maintain the door ajar from the doorframe. In some cases, an attachable feature of the device can remove the need to check the positioning of the device and the need to reposition the device.

Figure 1A:
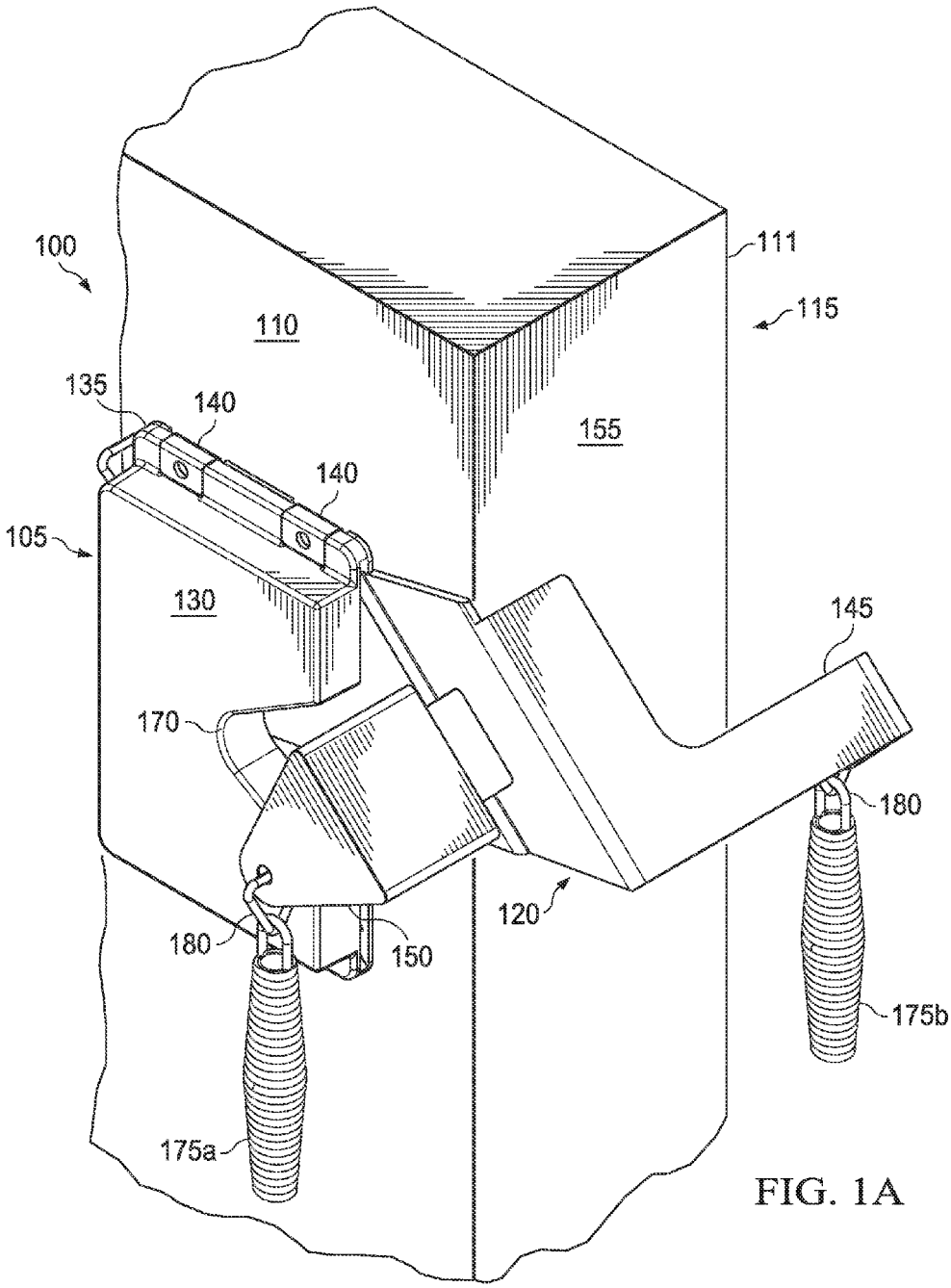
FIGS. 1A-1B illustrate isometric views of an example embodiment of a device for blocking closure of a door or other moveable structure.
Figure 1B:
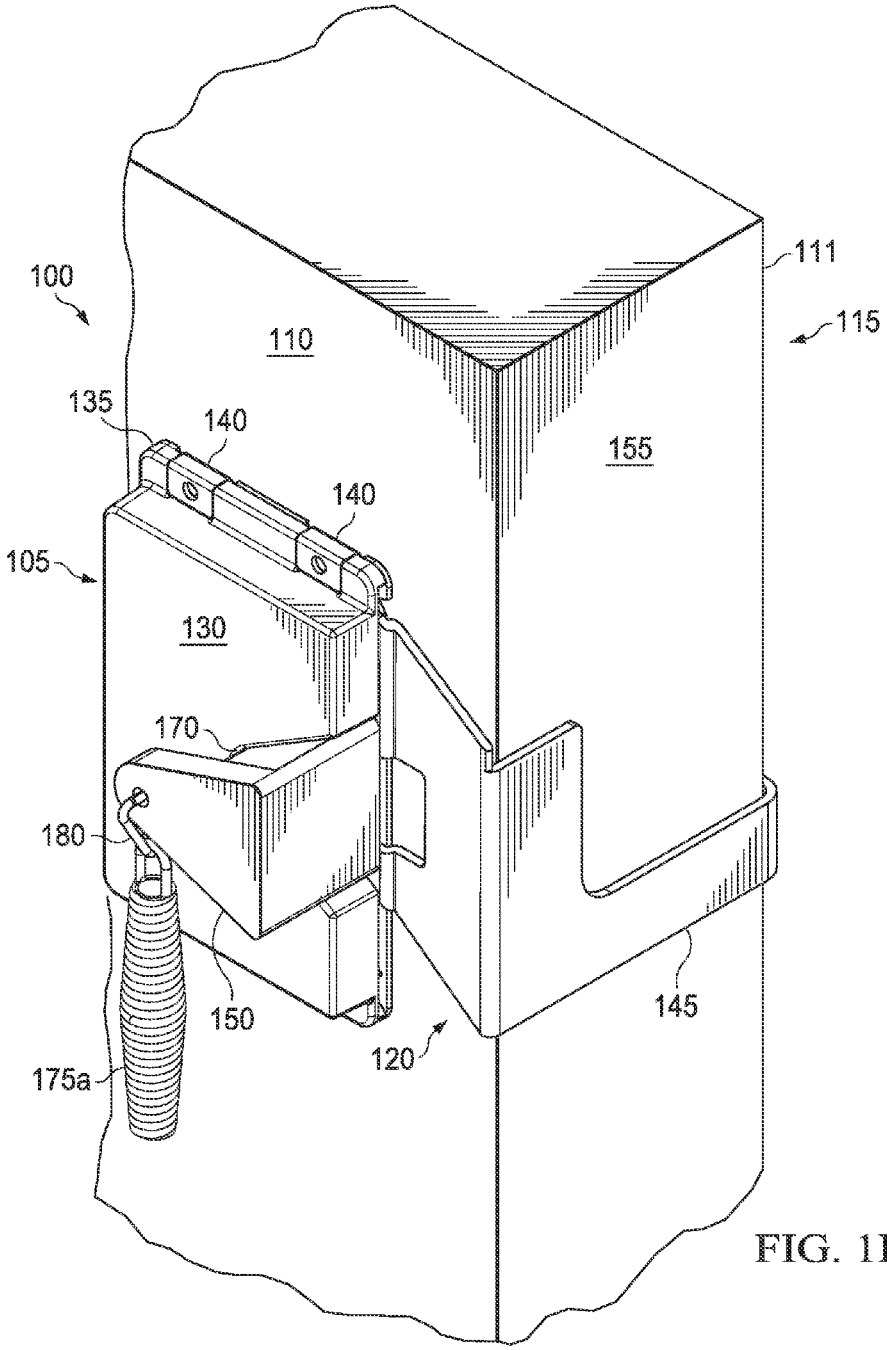
Figure 2A:
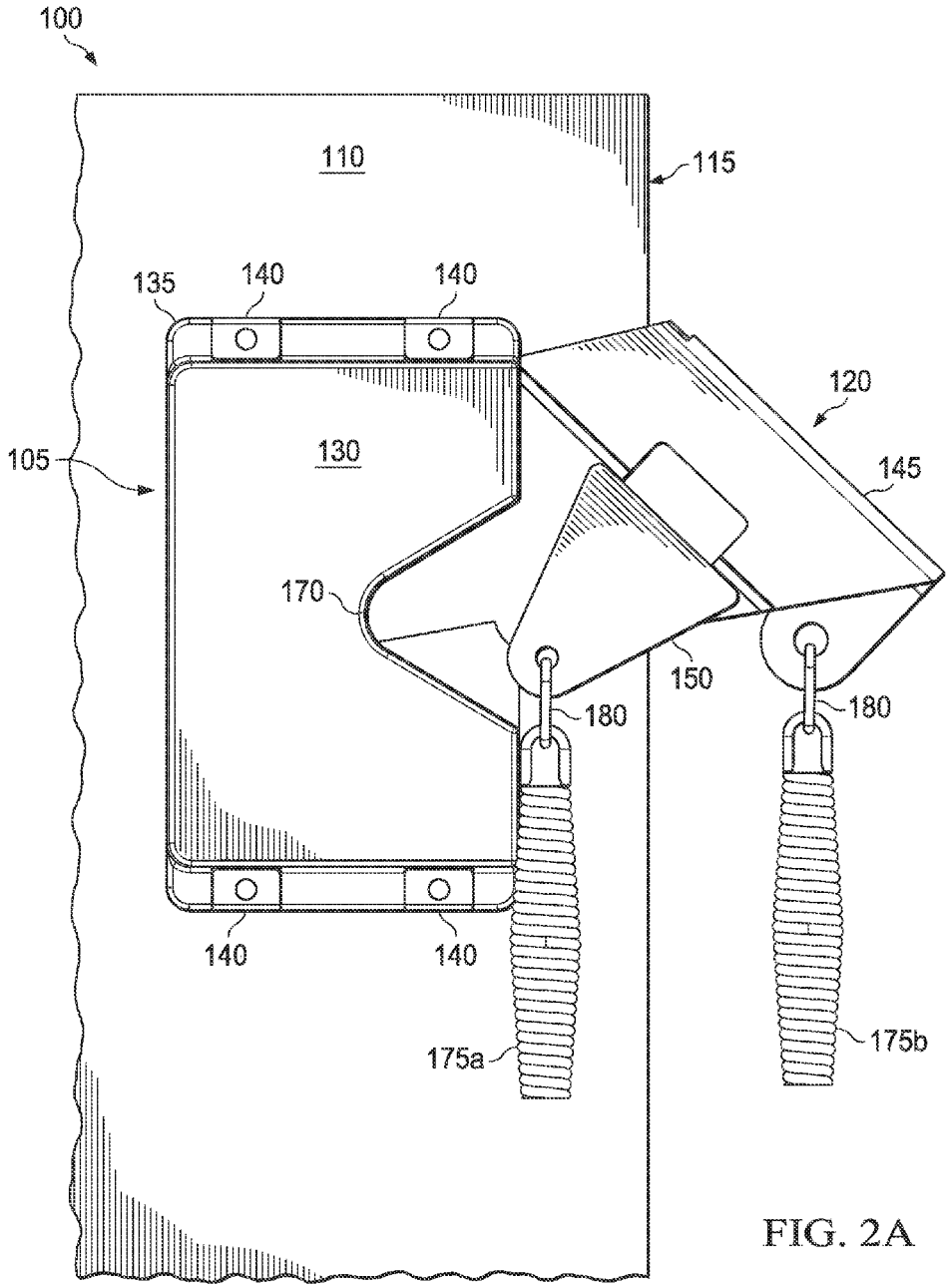
FIGS. 2A-2B illustrate front views of an example embodiment of a device for blocking closure of a door or other moveable structure.
Figure 2B:
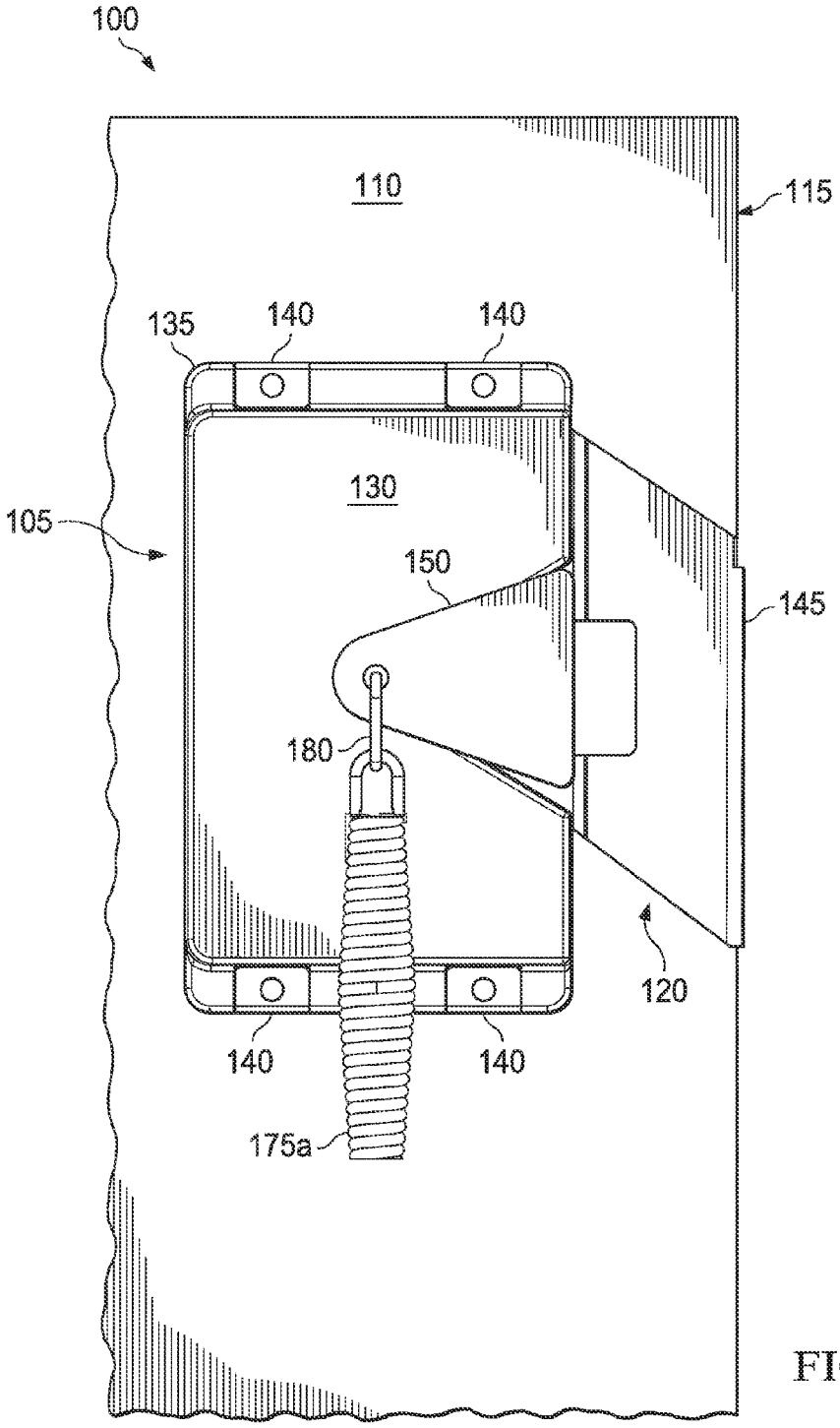

FIGS. 1A-1B and 2A-2B illustrate isometric views (FIGS. 1A-1B) and front views (FIGS. 2A-2B) of an example embodiment of a door block 100 illustrated in an extended configuration (FIGS. 1A and 2A) and a retracted configuration (FIGS. 1B and 2B). The illustrated door block 100 includes a base 105 that is attachable to a first side 110 of a door 115. The door block 100 further includes a swing arm 120 that is coupled to the base 105 with a fastener 125. With particular reference to FIGS. 1A and 2A, in some implementations, the swing arm 120 can be extended away from the base 105 and thus disposed at an acute angle with respect to the base 105. With particular reference to FIGS. 1B and 2B, in some implementations, the swing arm 120 can be retracted towards the base 105 and thus oriented parallel to the base 105.

Referring again to FIGS. 1A-1B and 2A-2B, the illustrated base 105 includes a hollow enclosure 130 and a plate 135 coupled to the enclosure 130 via one or more bracket flanges 140 extending from the plate 135. In some examples, the enclosure 130 can be made of one or more materials including, for example, molded plastic (e.g., polyethylene, polypropylene, polystyrene, polyvinyl chloride and polytetrafluoroethylene (PTFE)), aluminum or other metal, or other rigid or semi-rigid material. In some examples, the plate 135 can be made of one or more materials including, for example, steel, aluminum, another metal material, or other rigid or semi-rigid material. In some implementations, the fastener 125 can be a grommet fastener and/or a rivet. Further, additional fasteners (not shown) may couple, for example, the plate 135 to the stop 150, and the swing arm 120 to the plate 135. One or more of the fasteners (such as fastener 125 and other fasteners) may be a flat head screw or rivet mounted flush with, for instance, the plate 135, the stop 150, or other components of the door block 100.

In some embodiments, the swing arm 120 includes a bracket flange 145 and a stop 150 that is coupled to the bracket flange 145. A shape of stop 150 can generally be arbitrary. In some examples, the bracket flange 145 can extend across an edge 155 of the door 115 from the first side 110 of the door 115 to a second side 111 of the door 115. In some embodiments, the enclosure 130 can include a cutout 170 having a shape that accommodates the stop 150 when the swing arm 120 is retracted towards the base 105.

In some embodiments, the door block 100 can include a first pull handle 175*a* that allows the door block 100 to be accessed from the first side 110 of the door 115. In some examples, the first pull handle 175*a* is coupled to the stop 150. In some embodiments, the door block 100 can further include a second pull handle 175*b* that allows the door block 100 to be accessed from the second side 111 of the door 115. In some embodiments, the second pull handle 175*b* is coupled to the bracket flange 145. In some examples, one or more of the pull handles 175*a*, 175*b* can be a coiled tube, a hook, a chain, and a string. In some examples, one or more of the pull handles 175*a*, 175*b* can be coupled to the stop 150 and the bracket flange 145 via attachment rings 180 that encircle top ends of the pull handles 175*a*, 175*b* and cutouts within the stop 150 and the bracket flange 145.

Figure 3A:
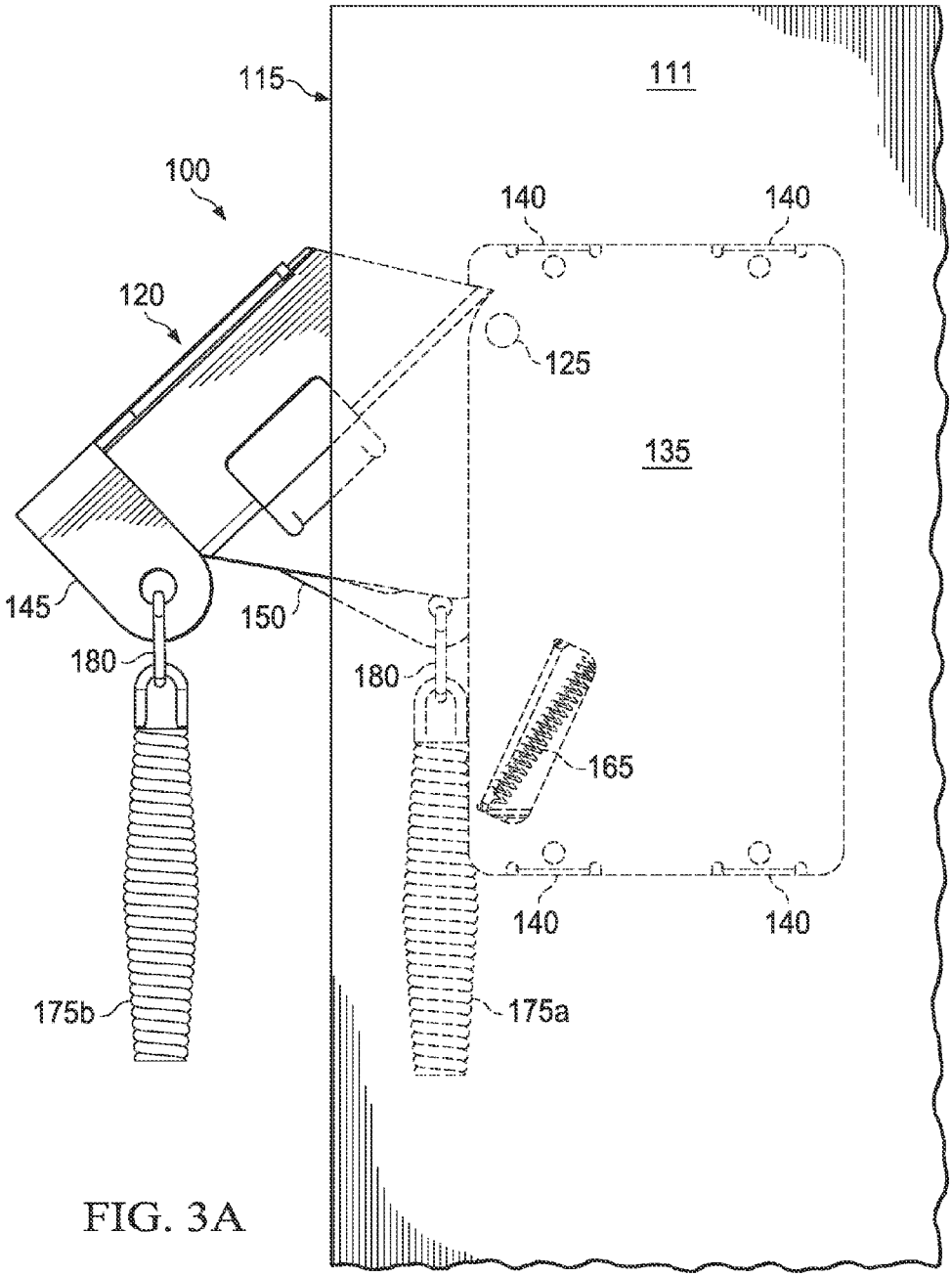
FIGS. 3A-3B illustrate back views of an example embodiment of a device for blocking closure of a door or other moveable structure.
Figure 3B:
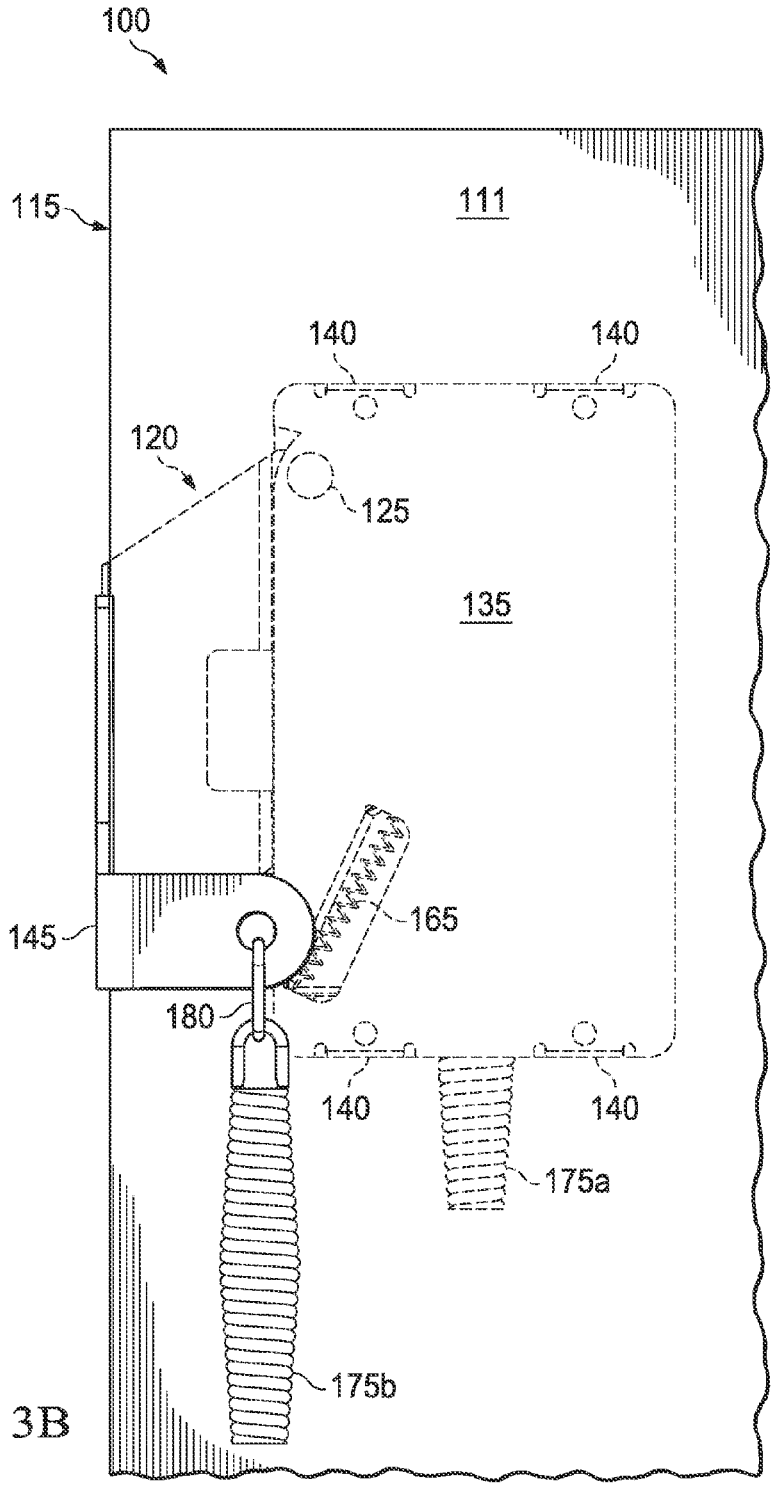

FIGS. 3A-3B illustrate back views of the door block 100 disposed in the extended configuration (FIG. 3A) and the retracted configuration (FIG. 3B). The door block 100 further includes a biasing member 165 that couples the swing arm 120 to the base 105 and that biases the swing arm 120 to an extended position. In some examples, the biasing member 165 may be coupled at a first end to the plate 135 and coupled at a second end to the swing arm 120.

Figure 4A:
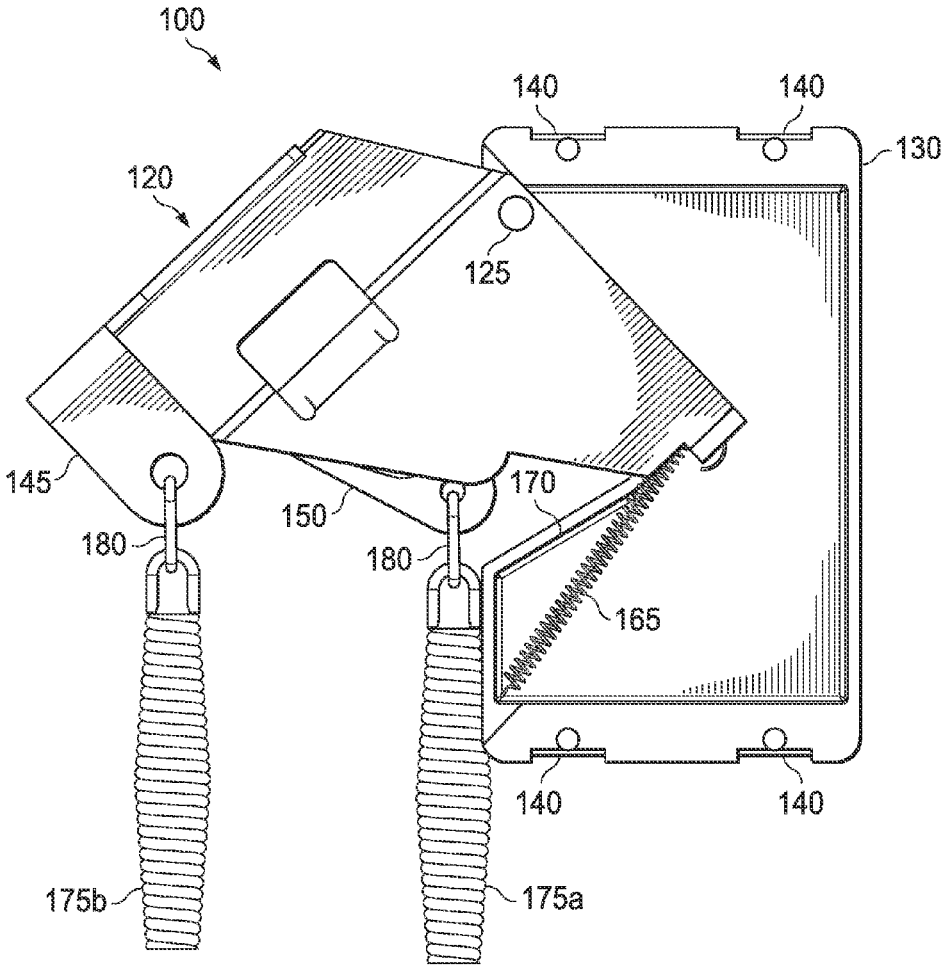
FIGS. 4A-4B illustrate sectional views of an example embodiment of a device for blocking closure of a door or other moveable structure.
Figure 4B:
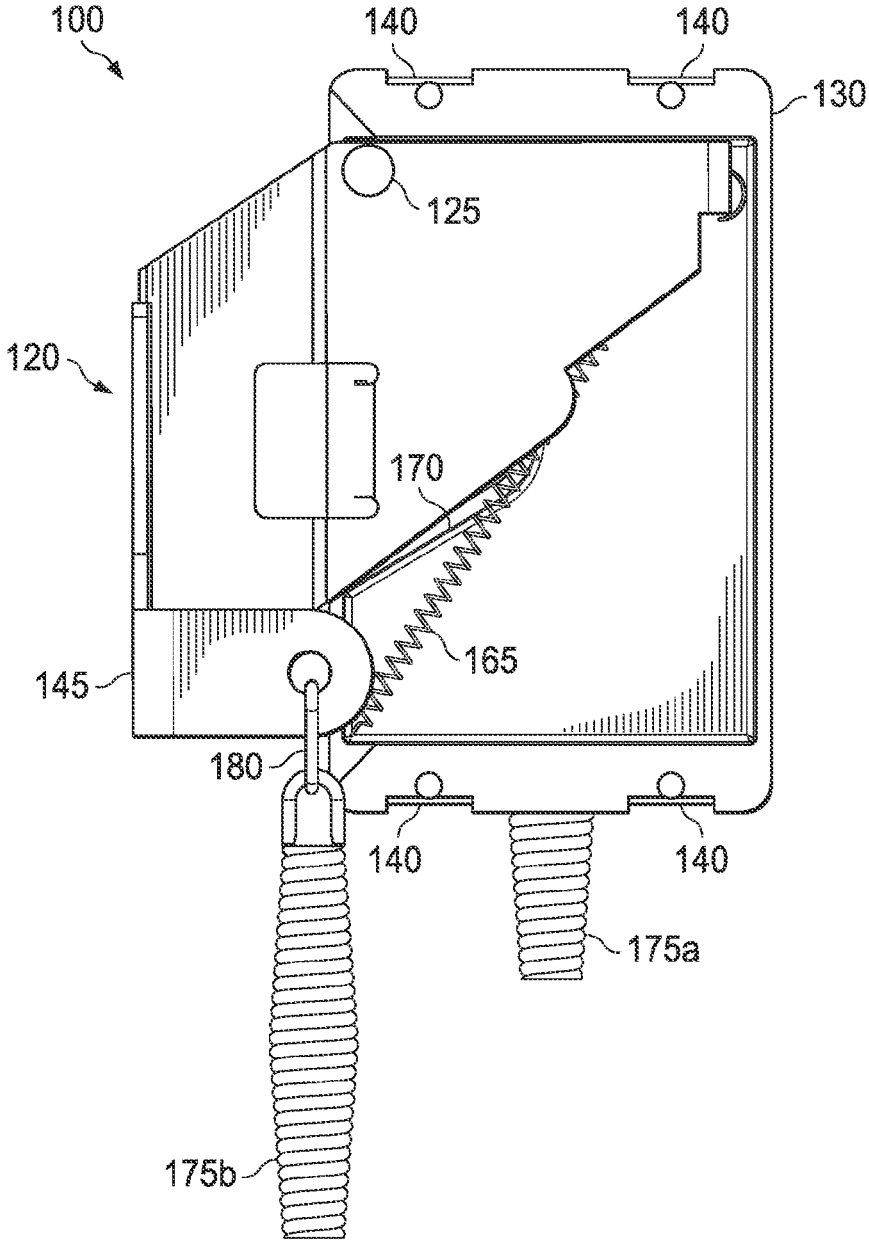

FIGS. 4A-4B illustrate sectional views of the door block 100 disposed in the extended configuration (FIG. 4A) and the retracted configuration (FIG. 4B) (door 115 omitted to more clearly show the door block 100). In some embodiments, the biasing member 165 can be housed within the enclosure 130. In some examples, the biasing member 165 can be a coil spring 165. In some embodiments, the biasing member 165 can be made of one or more materials including steel, aluminum, or other metal, or an elastomer polymer or other rubber.

With particular reference to FIGS. 3A and 4A, the biasing member 165 can be configured to bias the swing arm 120 away from the base 105, such that the swing arm 120 is disposed in an extended (open) position, and the stop 150 can prevent the door 115 from completely closing within a doorframe (not shown), thereby further preventing the door 115 from smashing an object, such as a finger, between the door 115 and the doorframe. For example, as the door 115 swings towards the doorframe, the door 115 can encounter the stop 150 instead of contacting the doorframe, thus preventing the door 115 from smashing an object disposed between the door 115 and the doorframe.

With particular reference to FIGS. 3B and 4B, the bracket flange 145 can be configured to be urged flush against the edge 155 of the door 115, such that the biasing member 165 extends and thereby disposes the swing arm 120 in a retracted (closed) position. In the retracted configuration, the door block 100 can allow the door 115 to close completely within the surrounding doorframe.

In some examples, the door block 100 can be used with a hinged door 115. In some implementations, the base 105 can be attached to the first side 110 of the door 115 with a piece of double-sided tape adhered to an external surface of the plate 135. In some examples, the door block 100 can be oriented substantially parallel to and disposed within close proximity to the edge 155 of the door 115. The door block 100 can further be attached to the door 115 at any height along the door 115.

In operation, the door block 100 can be adhered to the first side 110 of the door 115 such that the bracket flange 145 extends across the edge 155 of the door 115 from the first side 110 of the door 115 to a second side of the door 115. With particular reference to FIGS. 1A, 2A, 3A, and 4A, the swing arm 120 of the door block 100 is biased to an extended position away from the base 105 and thus prevents the door 115 from completely or substantially closing flush against a doorframe (not shown) surrounding the door 115. With particular reference to FIGS. 1B, 2B, 3B, and 4B, in order to allow the door 115 to close within the doorframe, one or more of the first and second pull handles 175*a*, 175*b* can be pulled to urge the swing arm 120 towards the base 105 until the bracket flange 145 is disposed against the edge 155 of the door 115, such that the swing arm 120 no longer provides an obstruction between the door 115 and the doorframe. With the bracket flange 145 disposed against the edge 155 of the door 115, the door 115 can be closed in the doorframe, and the one or more pull handles 175 can be released. Upon opening of the door 115 from the doorframe, the swing arm 120 can automatically return to an extended, biased position away from the base 105, thereby preventing the door 115 from closing within the doorframe.

Figure 5:
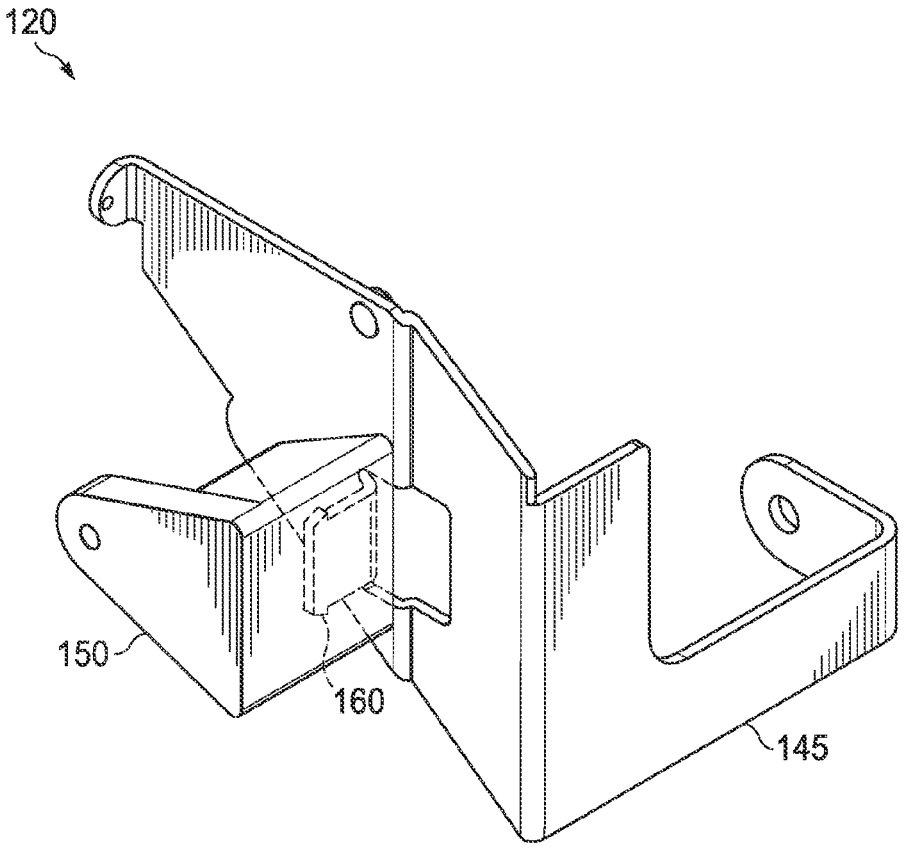
FIG. 5 illustrates a view of an example embodiment of a swing arm of a device for blocking closure of a door or other moveable structure.

FIG. 5 illustrates a view of an example embodiment of the swing arm 120 in accordance with the present disclosure. In some embodiments, the stop 150 can be seated on a flap 160 that is cut out and extends away from the bracket flange 145. In some embodiments, a width of the bracket flange 145 can range from, for example, approximately 1 to approximately 2⅜ inches to accommodate door thicknesses in a range of 1.25-2.25 inches. In some embodiments, a thickness of the bracket flange 145 can be approximately 1/16 inch to accommodate up to a ⅛ inch gap between the door 115 and its surrounding doorframe. In some examples, the swing arm 120 can be made of one or more materials including, for example, steel, aluminum, brass, plastic, or other rigid or semi-rigid material. In some embodiments, the stop 150 can be made of one or more materials including, for example, molded plastic (e.g., polyethylene, polypropylene, polystyrene, polyvinyl chloride and polytetrafluoroethylene (PTFE)), aluminum or other metal, or other rigid or semi-rigid material.

Referring again to FIGS. 1A through 4B, the example door block 100 is configured for use with a left hand hinge door having a normal swing direction. As defined herein, a left hand hinge door is a hinge door having hinges mounted on a left side of a door, as seen from the perspective of a person facing the first side 110 of the door 115. As defined herein, a normal swing direction is the direction pointed away from a person entering a doorway and facing the first side 110 of the door 115. The example door block 100 shown in FIGS. 1A through 4B is further configured for use with a right hand hinge door having a reverse swing direction. As defined herein, a right hand hinge door is a hinge door having hinges mounted on a right side of a door, as seen from the perspective of a person facing the first side 110 of the door 115. As defined herein, a reverse swing direction is the direction pointed towards a person entering a doorway and facing the first side 110 of the door 115.

In some embodiments, a door block can be configured as a mirror image of the door block 100, such that the door block is configured for use with a right hand hinge door having a normal swing direction and a left hand hinge door having a reverse swing direction. Alternatively, the door block 100 may be mounted on either of a left hand hinged door or a right hand hinged door by, for example, inverting the door block 100 and attaching the door block 100 upside down on the door.

In some examples, a door block (e.g., the door block 100) can act as a safety mechanism by preventing a door from smashing a small object, such as a finger or a child's hand, between a door and a doorframe. By positioning the door block at a sufficient height along a door, a small child can further be prevented from having access to the door block and thus from adapting the door block from an extended configuration to a refracted configuration and vice versa. In some examples, the door block can be used to maintain a door ajar from a doorframe, irrespective of associated safety aspects of the door block. In some examples, the attachable feature of the door block can remove the need to check the positioning of the door block and the need to reposition the door block, in contrast to movable, floor-seated stops that can easily be displaced from their intended positions and thus may require repositioning.

A number of embodiments have been described. Nevertheless, it will be understood that various modifications may be made. For example, although a coil spring is shown in the illustrated embodiments, other types of biasing members (e.g., elastic bands) may be used in place of the coil spring. Furthermore, various combinations of the components described herein may be provided for embodiments of a similar apparatus. Accordingly, other embodiments are within the scope of the present disclosure.

What is claimed is:

1. A device, comprising:

a base attachable to a door;

a swing arm attached to the base, the swing arm comprising:

a bracket flange that comprises: a first member that extends a distance from a proximal end near the base to a distal end opposite the proximal end, and a second member that is attached substantially orthogonally to the first member;

a first handle attached to the swing arm adjacent the distal end of the first member; and a biasing member that is attached at a first end to the swing arm and at a second end to the base, the biasing member biased to urge the swing arm from a retracted position in which the bracket flange is near the base towards an extended position in which the bracket flange is apart from the base.

2. The device of claim 1, wherein the biasing member is biased to pivotally urge the swing arm away from the base.

3. The device of claim 1, wherein the base comprises an enclosure and a plate.

4. The device of claim 3, further comprising a stop coupled to the bracket flange.

5. The device of claim 4, wherein the enclosure comprises a cutout having a shape that accommodates the stop.

6. The device of claim 1, further comprising an adhesive disposed along a rear surface of the base.

7. The device of claim 1, wherein a width of the bracket flange is about 1⅜ inches.

8. The device of claim 1, wherein a thickness of the bracket flange ranges from approximately 1/32 inch to 3/32 inch.

9. The device of claim 1, wherein the biasing member comprises a coil spring.

10. The device of claim 3, wherein at least a portion of the biasing member is enclosed within the enclosure.

11. The device of claim 1, further comprising a third member that is coupled substantially orthogonally to the first member at the distal end and spaced apart from the second member that is coupled to the first member at the proximal end, wherein the first handle is coupled to the second member and a second handle is coupled to the third member.

12. The device of claim 1, wherein the biasing member is biased to resist movement of the bracket flange towards the edge of the door.

13. An apparatus comprising:

a base comprising a back side that comprises an adhesive surface;

a swing arm coupled to the base, the swing arm comprising a substantially u-shaped bracket flange that comprises:

a first member that extends from the base and is substantially parallel to the back side of the base;

a second member that extends orthogonally from the first member;

a third member that extends from the second member and is substantially parallel to the first member; and a stop mounted to the first member;

a first handle coupled to either of the first member or the stop;

a second handle coupled to the third member; and a biasing member, directly attached between the swing arm and the base, that urges the swing arm from a retracted position in which the bracket flange is adjacent the base to an extended position in which the bracket flange is apart from the base.

14. The apparatus of claim 13, wherein the swing arm is biased by the biasing member away from the base.

15. The apparatus of claim 13, wherein the base comprises an enclosure and a plate.

16. The apparatus of claim 15, wherein the enclosure comprises a cutout having a shape that accommodates the stop.

17. The apparatus of claim 15, wherein at least a portion of the biasing member is enclosed within the enclosure.

18. The apparatus of claim 13, wherein the biasing member comprises a coil spring.

19. A device, comprising:

a base comprising an enclosure and a plate, the plate comprising an adhesive backing;

a swing arm attached to the base, the swing arm comprising a bracket flange that comprises: a first member that extends a particular distance from a proximal end near the base to a distal end opposite the proximal end, and a second member that is attached substantially orthogonally to the first member;

a first handle attached to the swing arm adjacent the distal end of the first member and a second handle attached to the swing arm adjacent a proximal end of the first member; and a biasing member, attached at a first end to the swing arm and at a second end opposite the first end to the base, the biasing member biased to pivotally urge the swing arm away from the base from a retracted position in which the first member is substantially parallel to a vertical direction to an extended position in which the first member is angularly offset from the vertical direction.

20. A system, comprising:

a door;

a base attachable to a first side of the door;

a swing arm coupled to the base, the swing arm comprising a bracket flange that comprises a first member that extends from a proximal end near the base to a distal end opposite the proximal end and across a width of the door and a second member that is coupled substantially orthogonally to the first member;

a first handle coupled to the swing arm adjacent the distal end of the first member and a second handle coupled to the swing arm adjacent a proximal end of the first member; and a coil spring directly attached between the swing arm and the base, the coil spring biased to pivotally urge the swing arm from a retracted position in which the bracket flange is adjacent an edge of the door across the width of the door to an extended position in which the bracket flange is apart from the edge.

21. An apparatus comprising:

a base comprising a back side that comprises an adhesive surface, the base comprising an enclosure and a plate;

a swing arm coupled to the base, the swing arm comprising a substantially u-shaped bracket flange that comprises:

a first member that extends from the base and is substantially parallel to the back side of the base;

a second member that extends orthogonally from the first member;

a third member that extends from the second member and is substantially parallel to the first member; and a stop mounted to the first member;

a first handle coupled to either of the first member or the stop;

a second handle coupled to the third member; and a biasing member that comprises a spring or elastic member, coupled between the swing arm and the base, that urges the swing arm from a retracted position in which the bracket flange is adjacent the base to an extended position in which the bracket flange is apart from the base.

* * * * *